US006520333B1

(12) United States Patent
Tschantz

(10) Patent No.: US 6,520,333 B1
(45) Date of Patent: Feb. 18, 2003

(54) TUBULAR INFLATABLE PACKAGING CUSHION WITH PRODUCT POCKET

(76) Inventor: Michell Tschantz, 4 Chestnut Knoll Dr., Sandy Hook, CT (US) 06482

( * ) Notice: Subject to any disclaimer, the term of this patent is extended or adjusted under 35 U.S.C. 154(b) by 0 days.

(21) Appl. No.: 09/549,281

(22) Filed: Apr. 14, 2000

(51) Int. Cl.[7] ..... B65D 81/02
(52) U.S. Cl. ..... 206/522; 383/3
(58) Field of Search ..... 206/522, 591, 206/592, 594; 383/3

(56) References Cited

U.S. PATENT DOCUMENTS 3,319,685 A * 5/1967 Urban ..... 383/3
4,569,082 A * 2/1986 Ainsworth et al. ..... 206/522
4,793,123 A * 12/1988 Pharo ..... 206/522
4,801,213 A * 1/1989 Frey et al. ..... 383/3
4,872,558 A 10/1989 Pharo
4,874,093 A 10/1989 Pharo
4,918,904 A 4/1990 Pharo
4,949,530 A 8/1990 Pharo
5,272,856 A 12/1993 Pharo
5,447,235 A * 9/1995 Pharo ..... 206/522
5,487,470 A 1/1996 Pharo
5,509,255 A * 4/1996 Rutledge ..... 206/522
5,588,532 A 12/1996 Pharo
5,711,691 A 1/1998 Damask

* cited by examiner

*Primary Examiner*—Luan K. Bui
(74) *Attorney, Agent, or Firm*—Ware, Fressola, Van Der Sluys & Adolphson LLP

(57) ABSTRACT

An inflatable packaging cushion includes an inflatable tube having inner and outer walls secured together at their ends, longitudinal seams dividing the tube into elongated inflatable compartments, and a valve for inflating the tube. A product area is thereby defined within the inflatable tube. A pocket is secured to the inflatable tube and is disposed in the product area. The pocket defines a mouth for receiving a product and an end for retaining a product therein. The pocket further includes a flap foldable over the mouth for retaining a product therein. The end and mouth of the pocket are spaced from the ends of the inflatable tube. The pocket is formed of spunbonded olefin and the inflatable tube is formed of polyethylene film.

24 Claims, 5 Drawing Sheets

TUBULAR INFLATABLE PACKAGING CUSHION WITH PRODUCT POCKET

FIELD OF THE INVENTION

The invention herein relates to a tubular inflatable packaging cushion with a pocket for positioning and isolating a product therein.

BACKGROUND OF THE INVENTION

Tubular inflatable packaging cushions are known. They generally consist of an elongated tubular sleeve with inner and outer walls, and valve means for inflating the space between the walls. The inner and outer walls are usually connected by seams at their ends and by additional seams extending along the walls in an axial direction, to divide the cushion into elongated inflatable compartments.

A product may be placed within the tubular sleeve, and the tubular sleeve is then inflated. This causes the tubular sleeve to closely surround and engage the product. Thus, the inflatable packaging cushion holds the product and provides an inflated sleeve of air around the product to cushion it against impact.

Protection of the product is in part dependent on how well the product is held in place. If it is not held firmly, the product can slide out of the end of the tubular sleeve, and thereby become partially or wholly unprotected. Also, any such sliding movement of the product relative to the tubular sleeve can damage the material from which the tubular sleeve is made. The material is generally relatively soft polyethylene based film, and abrasion, scratches or cuts on the surface of the film can cause it to leak, or can lead to immediate rupture of the packaging cushion on impact, i.e., precisely when the protection is needed.

The best known way to reduce the movement of the product relative to the tubular sleeve is to increase the inflation pressure. This can be counterproductive, because the increased pressure can lead to damage being inflicted on the cushion by the product. Also, if the product is transported by unpressurized freight aircraft or by land vehicle over mountains, the lower ambient pressure at high altitude creates a higher relative inflation pressure of the cushion. This tends to expand the cushion and can lead to damage to an outer carton in which the cushion and product are packed, or in extreme cases can lead to rupture and failure of the cushion itself.

Accordingly, there are problems associated, with present packaging cushions that need to be solved to improve their effectiveness and acceptability for widespread use.

SUMMARY OF THE INVENTION

It is a principal object of the invention herein to provide an improved tubular inflatable packaging cushion.

It is an additional object of the invention herein to provide a tubular inflatable packaging cushion that provides for positioning the product within the tube and preventing the product from sliding out of the tube.

It is a further object of the invention herein to provide a tubular inflatable packaging cushion that holds the product in a desired position within the tube.

It is another object of the invention herein to provide a tubular inflatable packaging cushion that resists damage from contact with the product held therein.

In carrying out the foregoing objects of the invention, there is provided an inflatable packaging cushion comprising an inflatable tube having an outer tube wall and an inner tube wall joined together at their ends. The inner tube wall defines a product area within the inflatable tube. A pocket is secured to the inflatable tube and is disposed in the product area. The pocket defines a mouth for inserting a product and an end opposite the mouth for restraining the product within the pocket. Valve means provide for inflating the inflatable tube to surround and cushion a product received in the pocket.

According additional aspects of the invention, the inner and outer tube walls are connected by spaced apart longitudinal seams dividing the inflatable tube into elongated inflatable compartments. The pocket is positioned adjacent the inner wall of one of the compartments.

According to other aspects of the invention, the inner and outer tube walls of the inflatable tube are seamed together at their ends, and the pocket is connected to the inflatable tube sleeve at one of the end seams. According to an alternative aspect, the pocket is connected to the inflatable tube at a longitudinal seam.

According to further aspects of the invention, the mouth of the pocket is spaced from the end of the inflatable tube, and the end of the pocket opposite the mouth is also positioned spaced apart from the opposite end of the inflatable tube. In a more specific aspect, the pocket is provided with a pocket flap foldable over the mouth of the pocket, for closing the pocket with the product received therein.

According to additional aspects of the invention, the pocket is formed of a high strength puncture resistant material. According to a specific aspect of the invention, the pocket is formed of spunbonded olefin. Other pocket materials are available for other specific requirements and applications.

A further aspect of the invention contemplates an inflatable packaging cushion having a pocket attached thereto, for receiving and positioning a product with respect to the cushion.

Other objects and features of the invention herein will in part be obvious to those skilled in the art and will in part appear in the following description of the preferred embodiments and the claims, taken together with the drawings.

BRIEF DESCRIPTION OF DRAWINGS

The same reference numerals refer to the same elements throughout the various figures.

DESCRIPTION OF PREFERRED EMBODIMENTS

Figure 1:
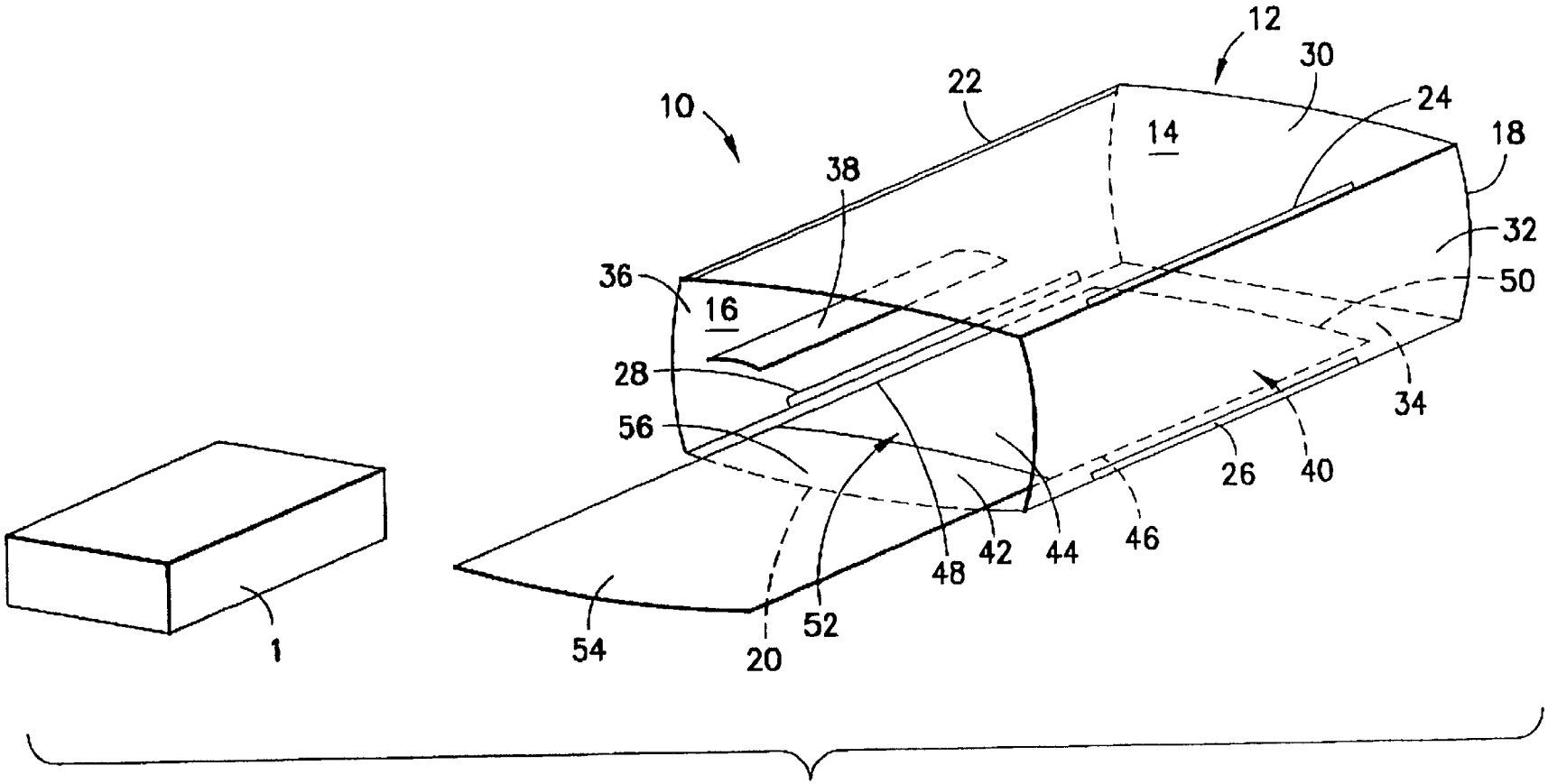
FIG. 1 is a perspective view of a tubular inflatable packaging cushion according to the invention herein, uninflated and positioned for receiving a product.

With reference to the FIGS. 1–5, there is illustrated an inflatable packaging cushion 10 adapted to receive, hold and protect an product 1. The inflatable packaging cushion 10 generally comprises an inflatable tube 12, which may or may not be cylindrical, and which has an outer wall 14 and an inner wall 16 (FIG. 5) joined at end seams 18 and 20. The outer wall 14 and inner wall 16 are also joined by longitudinal seams 22, 24, 26 and 28, which divide the inflatable tube 12 into four elongated inflatable compartments. Seam 22 also joins the outer and inner wall for fabrication purposes as more fully discussed below.

The longitudinal seam 22 and the adjacent longitudinal seam 24 form the top compartment 30, seam 24 and adjacent seam 26 form a side compartment 32, seams 26 and 28 form a bottom compartment 34, and seams 28 and 22 form a side compartment 36. The ends of the inflatable tube 12 are open.

A valve 38 extends through end seam 20 into the compartment 30, and the remaining compartments 32, 34 and 36 are in air communication with compartment 30, whereby introducing inflation air through valve 38 inflates the entire tube 12. Valve 38 also provides for deflating the tube 12 by releasing air, if desired. The valve 38 is of a well-known, two-layer construction which accepts an inflation tube.

The inflatable packaging cushion 10 further comprises a pocket 40 having a bottom panel 42 and a top panel 44, joined together along sides 46 and 48 and along an end 50. The bottom panel 42 and top panel 44 define an open mouth 52 opposite the closed end 50. The pocket 40 is secured to the inflatable tube 12 and is disposed adjacent the inner wall 16 thereof, adjacent compartment 34, and is further adapted to receive a product 1 and to hold an position the product 1 within the inflatable tube 12.

In the pocket 40 of inflatable packaging cushion 10, the bottom panel 42 extends outwardly from the top panel 44 and secures the pocket 40 to the inflatable tube 12 at end seam 20, and further extends beyond end seam 20 to provide a flap 54.

Figure 2:
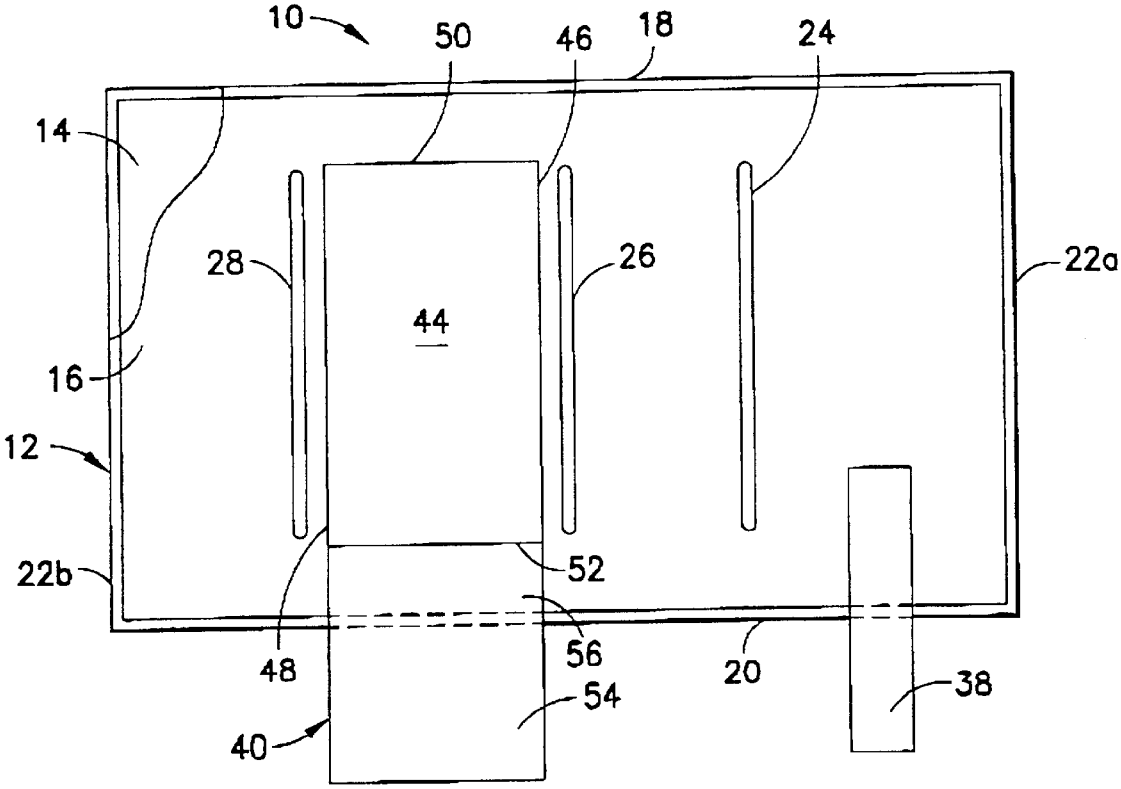
FIG. 2 is a plan view of the inflatable packaging cushion of FIG. 1 being fabricated.
Figure 3:
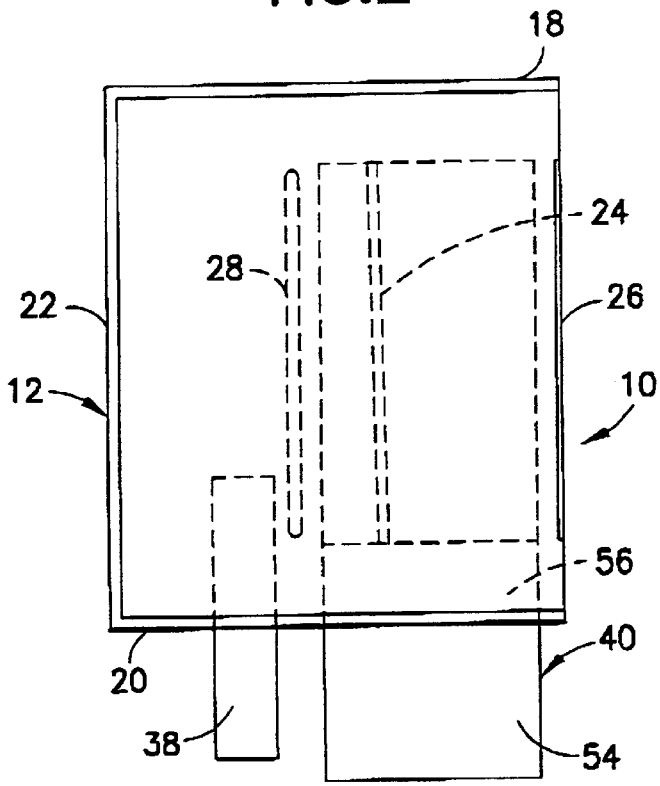
FIG. 3 is a plan view of the inflatable packaging cushion of FIG. 1, showing completion of the fabricating steps.

Fabrication of the inflatable packaging cushion 10 is illustrated in FIGS. 2 and 3. First, the pocket 40 is preferably fabricated by folding an elongated rectangular heat fusible pocket sheet 40 to form bottom panel 42 and top panel 44 joined by a fold at the end 50, and then heat fusing the sheet to itself along side seams 46 and 48. The mouth 52 is thereby defined between the top panel 44 and bottom panel 42, and the bottom panel 42 extends outwardly therefrom to provide an offset 56 and flap 54.

With continued reference to FIG. 2, the outer wall 14 and inner wall 16 of the inflatable tube 12 are formed of rectangular sheets of the thermoplastic material, placed in registration and forming two layers. The folded pocket 40 is placed adjacent the sheet forming the inner wall 16, having its mouth 52 offset from the edge of the sheets by the offset section 56 and the flap 54 extending outwardly of the sheets 14, 16. The valve 38 is inserted between the sheets 14 and 16. Once the pocket 40 and valve 38 have been placed, the sheets 14 and 16 are heat fused together along end seams 18 and 20 and longitudinal seams 24, 26 and 28. The pocket 40 is thereby attached to the inflatable tube 12 by heat fused seam 20, but it will be appreciated that the pocket 40 may be attached to the inflatable tube 12 at seam 26 or 28, or by a separate seam formed in a first fabrication step utilized to secure the pocket to the inner wall 16 before the inner and outer walls secured together. If desired, the inner and outer walls may be secured together at seams 22*a* and 22*b*, providing a good seal between the inner and outer walls.

With reference to FIG. 3, the subassembly illustrated in FIG. 2 is folded at seam 26 to align seams 22*a* and 22*b*, which are then heat fused together to form seam 22 and secure the sheets 14, 16 into the tubular configuration of inflatable tube 12. If seams 22*a* and 22*b* were not previously formed, then the four layers of sheets 14 and 16 are heat fused simultaneously to form seam 22.

The outer tube wall 14 and inner tube wall 16 are preferably fabricated of a heat fusible polymer, which may be polyethylene based polymer with metallocene fillers. Such material is sold by Uniplast Films, product number Q-871, and for an inflatable packaging cushion having a length of 30 inches and an uninflated circumference of 36 inches, a metallocened polyethylene film having a thickness of 5 mils is suitable. Such film in the range of approximately 3–9 mils is also suitable, particularly in different sized inflatable packaging cushions and other heat fusible films may also be used, balancing costs and performance objectives.

The pocket is preferably fabricated of spunbonded olefin, and a particular suitable pocket material is DuPont TYVEC spun bonded polyolefin, style 1056D, Grade D. This TYVEC spunbonded olefin has a nominal thickness of 6.4 mils, and it will be appreciated that other thicknesses or grades of spun bonded polyolefin may be utilized, or that other materials may be utilized, depending upon cost and performance objectives. The spun bonded polyolefin is particularly advantageous for its high puncture and tear resistance and its high resistance to abrasion.

Figure 4:
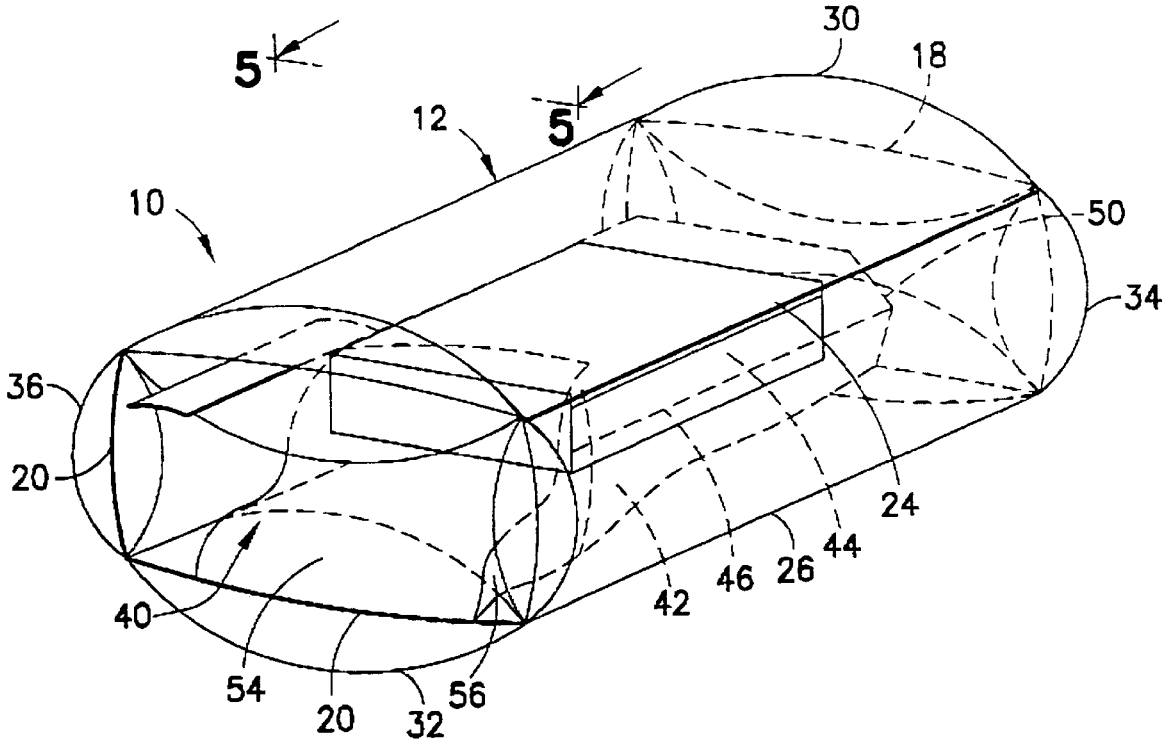
FIG. 4 is a perspective view of the inflatable packaging cushion of FIG. 1, shown with a product therein and inflated.
Figure 5:
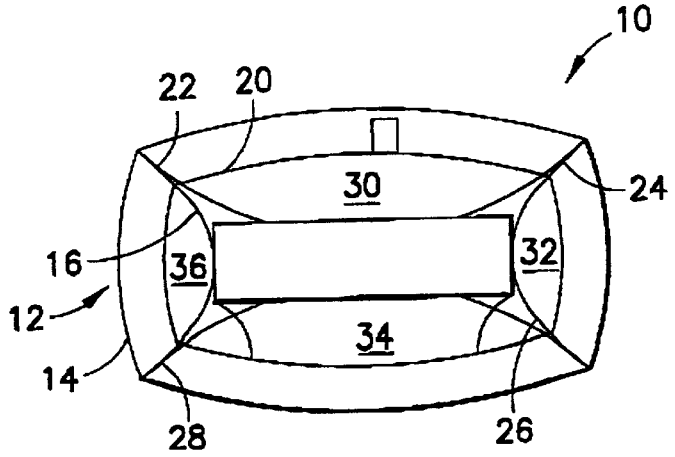
FIG. 5 is a sectional view of the inflatable packaging cushion of FIG. 1, taken along the lines 5—5 of FIG. 4.

With reference to FIGS. 1, 4 and 5, the inflatable packaging cushion 10 is used by manipulating the inflatable tube to a open position, as shown in FIG. 1, thereby exposing the mouth of 52 of pocket 40 for insertion of a product 1. The product 1 may be inserted to butt against the bottom 50 of the pocket 40, which is spaced from the seam 18 defining the end of the inflatable tube 12. The flap 54 of the pocket is then folded inwardly over the mouth 52. An inflation tube is inserted through valve 38, and the inflatable tube 12 is supplied with inflation air to inflate the inflatable tube 12 surrounding the pocket 40 and product 1, as shown in FIGS. 4 and 5. Thus, the product 1 is held within the pocket 40, and the product and the pocket are closely surrounded and held by the inflatable tube 12, whereby the product 1 is prevented from exiting the ends of the inflatable tube 12. Further, the material of the inflatable tube 12 is protected from contact with the product 1 which might otherwise abrade, scratch or cut the inner wall 16. A product 1 having sharp edges, protruding elements, exterior packaging staples, or the like may thereby be accommodated within the inflatable packaging cushion 10 without concern about failures from contact with the product.

It will also be appreciated that because of the product 1 is contained within the pocket 40, the inflation pressure is necessary to hold the product within the inflatable tube 12 does not need to be extremely high. Use of low to moderate inflation pressures permits the inflatable packaging cushion 10 to be transported at high altitude where it has a tendency to expand due to the higher pressure differential between the inflated interior of the inflatable tube 12 and the lower ambient pressure at high altitude.

Figure 6:
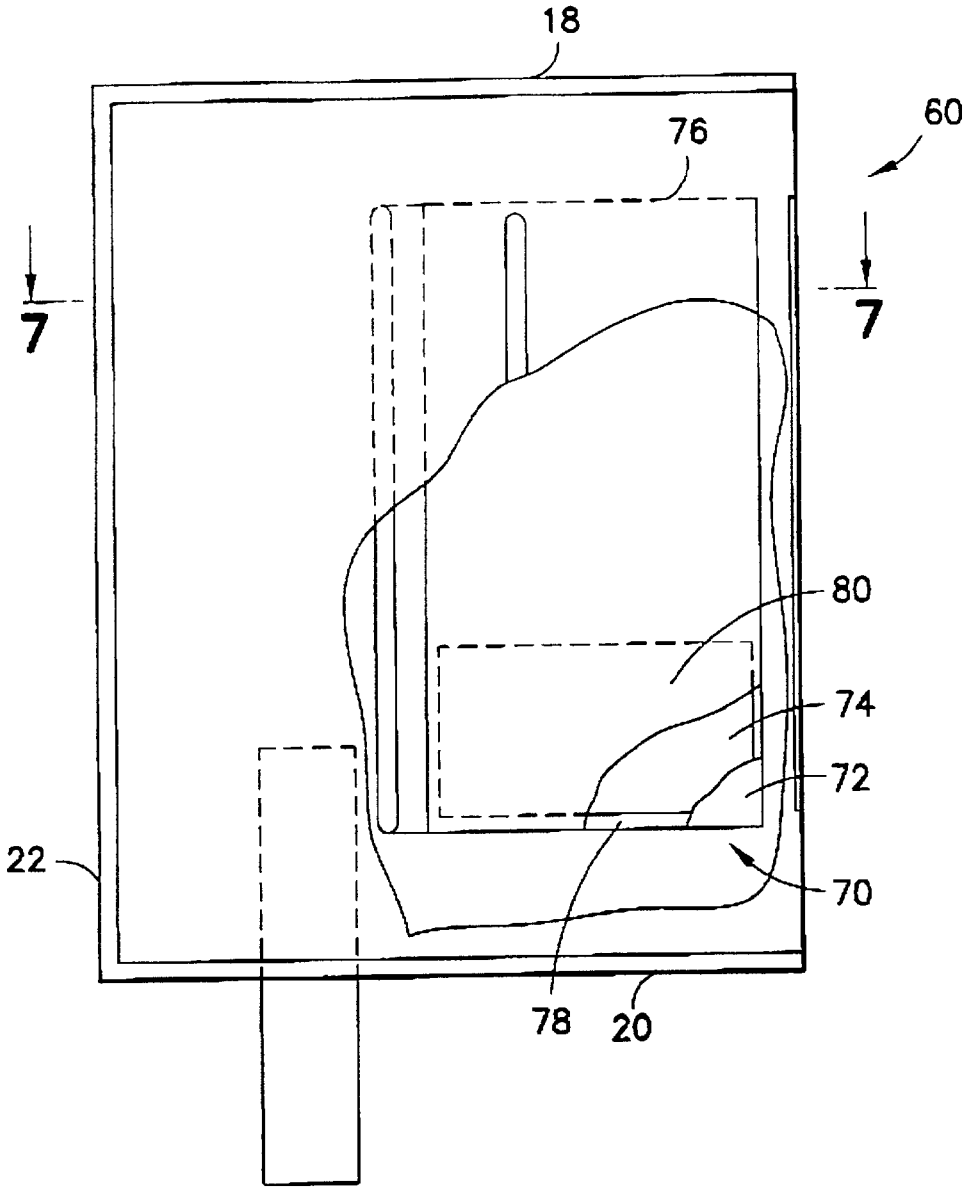
FIG. 6 is a plan view of another tubular inflatable packaging cushion according to the invention herein.
Figure 7:
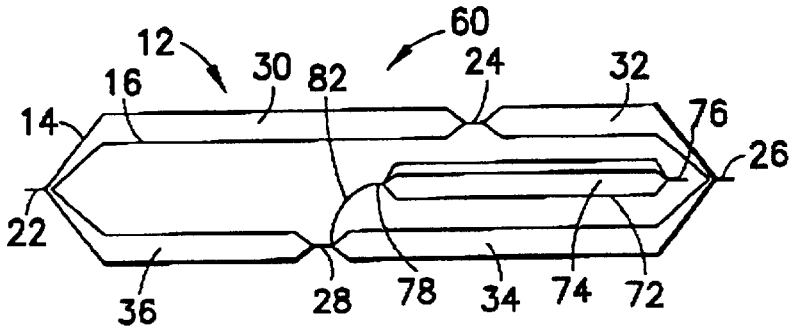
FIG. 7 is a sectional view of the inflatable packaging cushion of FIG. 6, taken along the lines 7—7 of FIG. 6.

With reference to FIGS. 6 and 7, another inflatable packaging cushion 60 according to the invention herein is shown. The inflatable packaging cushion 60 is similar to the inflatable packaging cushion 10 described above, except for the configuration and attachment of the pocket 40. Thus, with reference to FIGS. 6 and 7, the inflatable packaging cushion 60 has an inflatable tube 12 made of an outer wall 14 and an inner wall 16, joined together at end seams 18 and 20 and longitudinal seams 22, 24, 26 and 28 to form elongated inflatable compartments 30, 32, 34 and 36.

As noted above, the inflatable packaging tube 60 is characterized by a pocket 70 that includes a bottom wall 72 and a top wall 74, which are joined together at side seams 76 and 78. The pocket 70 may be fabricated of TYVEK or another thermoplastic so that the seams may be formed heat fusing. The top wall 74 is a folded over portion of the same material as bottom wall 72, providing a pocket end 76. The top wall and bottom wall define a mouth 78, seen in FIG. 6, and another portion of the material integral with the bottom wall 72 is folded over the mouth 78 in the form of a flap 80.

An additional portion of the pocket material, which may be integral with either the bottom wall 72 or top wall 74 or both, is provided as a connector web 82 extending from pocket side seam 78 to seam 28 of the inflatable tube 12. The web 82 attaches the pocket 70 to the inflatable tube 12.

The pocket 70 has the advantage of providing a flap 80 that closes over mouth 78 spaced from the end seam 20, for better restraining a product within the pocket and spaced from the ends of the inflatable packaging tube 60.

Figure 8:
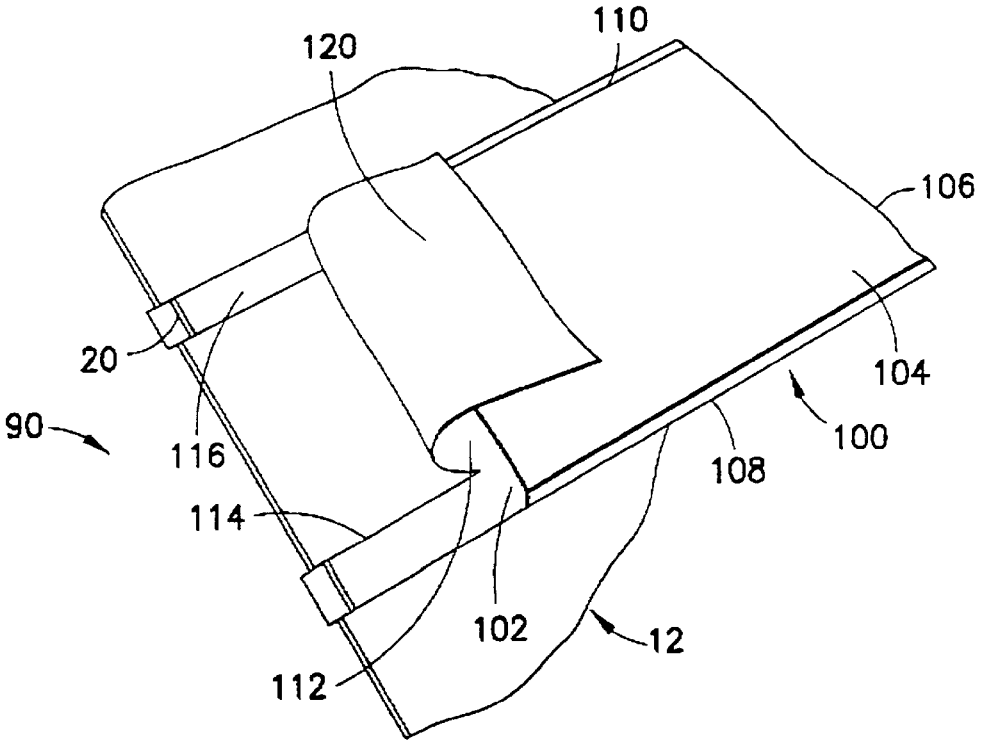
FIG. 8 is a segmental perspective view of another tubular inflatable packaging cushion according to the invention herein.
Figure 9:
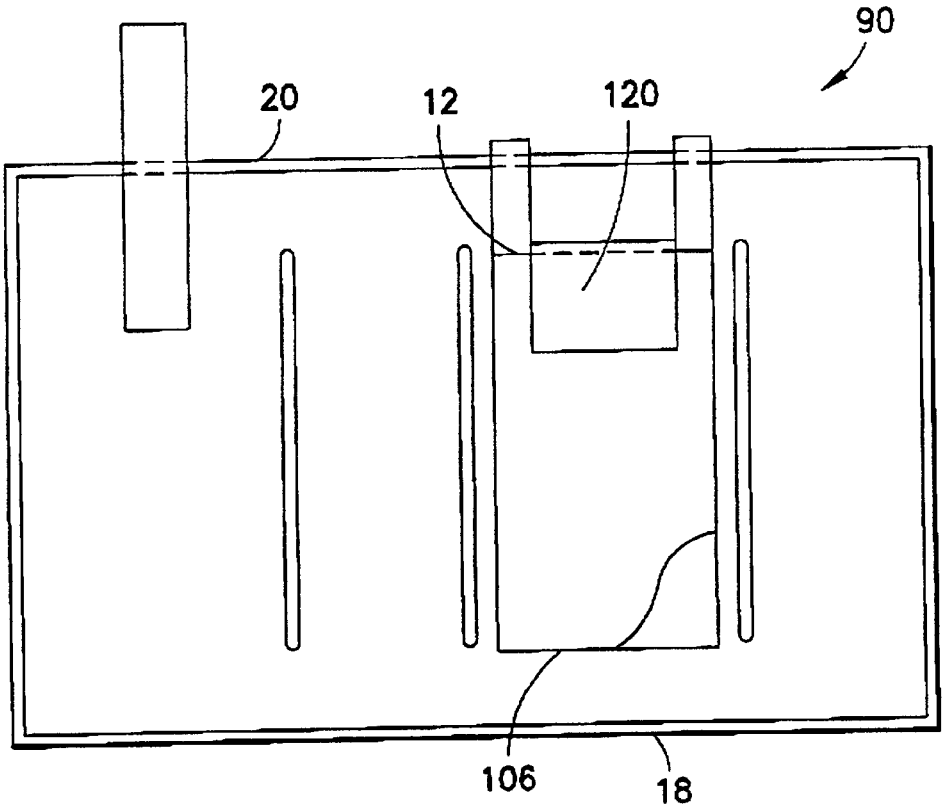
FIG. 9 is a plan view of the cushion of FIG. 8 being fabricated.

In FIGS. 8 and 9, yet another inflatable packaging cushion 90 is illustrated, also characterized by its pocket 100. The inflatable packaging cushion 90 comprises an inflatable tube 12 as described above. FIG. 8 corresponds to FIG. 3, in showing the fabrication of the inflatable packaging cushion 90, except for the features of the pocket 100. The pocket 100 has a bottom panel 102 and a top panel 104 which is preferably an integral extension of the bottom panel 102 folded to form end 106 of the pocket 100. The bottom panel 102 and top panel 104 are joined together at side seams 108 and 110. Thus, the bottom panel and top panel form a mouth 112 of the pocket 100.

The bottom panel 102 also has integral extending suspenders straps 114 and 116, which extend to and are heat sealed at the end seam 20 of the inflatable tube 12, to secure the pocket to the inflatable tube. The material of pocket 100 is heat fusible to facilitate this connection. The portion of the bottom panel 102 slit from between the suspender straps 114 and 116 forms a flap 120 which may be folded over the mouth 112 of the pocket 100. This provides an inflatable packaging cushion 90 with a pocket 100 having its end 106 spaced from the end seam 18 of its inflatable packaging tube 12, and having a mouth 112 of its pocket spaced from the end seam 20 of its inflatable tube 12, and a flap 120 for covering the mouth 112 to position and retain a product within the pocket 100.

It will be appreciated that changes may be made from the inflatable packaging cushions described above while still enjoying the benefits of the invention herein. For instance, the pocket may be placed at different locations within the inflatable tube 12, the valve may be placed at various locations, and a varying number of elongated inflatable compartments of selected sizes may be utilized to accommodate various sized products. Also, the inflatable packaging cushion may include a plurality of inflatable compartments and may be folded to surround a product, but are not connected as a tube, with the pocket attached thereto. Similarly the dimensions, materials and thicknesses of materials can be varied depending upon the desired size and application of the product.

The material of the pocket may also be varied for different applications. For instance, it may be an exceedingly soft and non-abrasive material for embracing products having exterior finishes that need to be protected during shipment, such as products with finish painting or polishing on their surfaces.

Accordingly, the inflatable packaging cushions described above are believed to admirably fulfill the objects of the invention herein. It will be appreciated by those that various changes may be made from the inflatable packaging cushions, which are illustrative only, without departing from the spirit and scope of the invention, which is limited only by the following claims.

I claim:

1. An inflatable packaging cushion comprising:

A) an inflatable tube having an outer tube wall and an inner tube wall joined together at first and second tube ends, the inner tube wall defining a product area surrounded by the inflatable tube and between the first and second tube ends thereof;

B) a pocket permanently secured to the inflatable tube and disposed in the product area, the pocket defining a mouth for receiving a product and an end-opposite the mouth for retaining a product within the pocket;

C) valve means for inflating the inflatable tube to surround and cushion a product received in the pocket;

D) said inflatable tube sized such that upon inflation thereof, it closely surrounds and holds the pocket and a product therein, whereby the product is prevented from exiting the first and second tube ends.

2. An inflatable packaging cushion as defined in claim 1 wherein the inflatable tube has elongated compartments defined by longitudinal seams joining the outer tube wall and inner tube wall.

3. An inflatable packaging cushion as defined in claim 2 wherein the pocket is positioned adjacent one of the elongated compartments.

4. An inflatable packaging cushion as defined in claim 2 wherein the end of the pocket is spaced apart from the first end of the inflatable tube, to position a product within the pocket spaced apart from the first end of the inflatable tube.

5. An inflatable packaging cushion as defined in claim 4 wherein the mouth of the pocket is spaced apart from the second end of the inflatable tube.

6. A inflatable packaging cushion as defined in claim 5 wherein the pocket is secured to the inflatable tube at a longitudinal seam thereof.

7. An inflatable packaging cushion as defined in claim 6 wherein the pocket includes a side seam and an offset web extending between the side seam and the longitudinal seam to secure the pocket thereto.

8. An inflatable packaging cushion as defined in claim 6 and further comprising a pocket flap extending from the open mouth of the pocket and foldable over the mouth of the pocket for retaining a product within the pocket.

9. An inflatable packaging cushion as defined in claim 5 wherein the inner tube wall and outer tube wall of the inflatable tube are heat fused together in an end seam at the second end of the inflatable tube and the pocket is secured to the inflatable tube by heat fusing at the end seam.

10. An inflatable packaging cushion as defined in claim 9 and further comprising a pocket flap extending from the mouth of the pocket and foldable over the mouth of the pocket for retaining a product within the pocket.

11. An inflatable packaging cushion as defined in claim 10 wherein the flap includes an offset portion spacing the mouth of the pocket from the second end of the inflatable tube.

12. An inflatable packaging cushion as defined in claim 9 wherein the pocket has at least one strap extending therefrom and the at least one strap is secured to the inflatable tube at the end seam to secure the pocket thereto.

13. An inflatable packaging cushion as defined in claim 12 and further comprising a pocket flap extending from the mouth of the pocket and foldable over the mouth of the pocket for retaining a product within the pocket.

14. An inflatable packaging cushion as defined in claim 13 wherein the pocket has two spaced apart straps extending therefrom and secured to the inflatable tube at the end seam, and the pocket flap folds from between the two straps over the mouth of the product.

15. An inflatable packaging cushion as defined in claim 1 wherein the pocket is formed of spunbonded olefin.

16. An inflatable packaging cushion as defined in claim 15 wherein the inner tube wall and outer tube wall comprise polyethylene.

17. An inflatable packaging cushion as defined in claim 16 wherein the polyethylene is metallocened low density polyethylene.

18. A inflatable packaging cushion as defined in claim 2 wherein the pocket is secured to the inflatable tube at a longitudinal seam thereof.

19. An inflatable packaging cushion as defined in claim 1 wherein the end of the pocket is spaced apart from the first end of the inflatable tube, to position a product within the pocket spaced apart from the first end of the inflatable tube.

20. An inflatable packaging cushion as defined in claim 19 wherein the mouth of the pocket is spaced apart from the second end of the inflatable tube.

21. An inflatable packaging cushion as defined in claim 1 and further comprising a pocket flap extending from the mouth of the pocket and foldable over the mouth of the pocket for retaining a product within the pocket.

22. An inflatable packaging cushion as defined in claim 1 wherein the pocket is formed of a single piece of material folded and seamed to provide the end and define mouth of the pocket.

23. An inflatable packaging cushion as defined in claim 22 and further comprising a pocket flap extending from the mouth of the pocket and foldable over the mouth of the pocket for retaining a product within the pocket, the pocket flap also formed of the single piece of material.

24. An inflatable packaging cushion as defined in claim 23 wherein the pocket is formed of sponbonded olefin.

* * * * *